United States Patent [19]

Cochran

[11] Patent Number: 4,498,413

[45] Date of Patent: Feb. 12, 1985

[54] CONSTRUCTION OF RIGID HULL INFLATABLE BOAT

[76] Inventor: William H. Cochran, 72 Water St., P.O. Box 32, Stonington, Conn. 06378

[21] Appl. No.: 475,768

[22] Filed: Mar. 16, 1983

[51] Int. Cl.[3] ..... B63B 7/00

[52] U.S. Cl. ..... 114/345

[58] Field of Search ..... 114/345, 360, 361, 68, 114/69, 219, 123

[56] References Cited

U.S. PATENT DOCUMENTS

| | | | |
|---|---|---|---|
| 1,104,428 | 7/1914 | Kertesz | 114/68 |
| 1,249,633 | 12/1917 | Jelercic | 114/360 |
| 1,622,508 | 3/1927 | Harper | 114/360 |
| 3,121,888 | 2/1964 | Morgan et al. | 114/360 |
| 3,141,438 | 7/1964 | Smith | 114/68 |
| 3,418,815 | 12/1968 | Kumazawa | 114/219 |
| 3,611,459 | 10/1971 | Sear et al. | 114/345 |
| 3,822,662 | 7/1974 | Morita et al. | 114/68 |
| 4,343,258 | 8/1982 | Belvedere | 114/219 |

FOREIGN PATENT DOCUMENTS

| | | | |
|---|---|---|---|
| 2497760 | 7/1982 | France | 114/123 |
| 288677 | 4/1928 | United Kingdom | 114/360 |

OTHER PUBLICATIONS

R. F. Burnett, High Speed Surface Craft, vol. 21, No. 1, pp. 4 to 13, Jan. 1982.

Dag Pike, Ship and Boat International, vol. 32, No. 12, pp. 33 to 35, 47, Dec. 1979.

E. H. de Montalgu, Offshore, Mar. 1982, pp. 93, 94 and 96.

*Primary Examiner*—Trygve M. Blix

*Assistant Examiner*—Jesûs D. Sotelo

*Attorney, Agent, or Firm*—Cushman, Darby & Cushman

[57] ABSTRACT

A rigid inflatable boat (RIB) is provided having multiple inflatable bladders defining a ring around the hull generally at or above the waterline, with the inflatable bladders connected to the hull and to each other in a manner facilitating rapid mounting and demounting, and easy repair, thereof. A positioning structure, such as a through-extending hole, is formed in the hull for positioning each bladder with respect to the hull, and a holding structure, such as a separate inflatable portion of the bladder, or a rigid flange, or a strap is associated with each bladder to cooperate with the positioning structure to releasably hold each bladder to the hull at the positioning structure when the bladder is inflated, while allowing ready demounting when the bladder is deflated. The bladders may be provided with interlocking end structures to stabilize the positions of the bladders with respect to each other, and the hull. A shroud or shrouds may also surround the bladders.

14 Claims, 9 Drawing Figures

CONSTRUCTION OF RIGID HULL INFLATABLE BOAT

BACKGROUND AND SUMMARY OF THE INVENTION

Rigid inflatable boats (commonly known as "RIBs") have found increasing use in rescue operations, especially in heavy seas. Also, RIBs have proven capable of being launched and retrieved from larger vessels while the larger vessels are underway. RIBs have a rigid hull that normally is either of aluminum or GRP construction, are powered, and have an internally sectioned rubber ring (called a "tube") disposed substantially around the entire periphery of the hull generally at or above the waterline. These boats have remarkably good stability, buoyancy, speed, and resilience to crushing, in a wide variety of sea conditions.

Typically the inflatable components of RIBs are produced by labor intensive methods, by cutting and adhesively seaming elastomer-coated textile fabric, and are adhered to the hull by adhesives or other methods which do not facilitate the rapid mounting and demounting thereof. Since multiple chambers are provided in a common structure, repair is the sole alternative to total replacement, and is difficult. Also, such structures are difficult to stack for shipment or storage when the inflatable element is attached to the hull.

According to the present invention, a structure is provided that, in combination with a rigid hull of a boat, eliminates many of the drawbacks associated with conventional RIB inflatable elements, while still providing the necessary stability, resilience and buoyancy to the boat. According to the invention, a plurality of inflatable elastomeric material bladders are provided, the bladders being disposed in end-to-end relationship around substantially the entire periphery of the hull so as to provide a desired inflatable ring. Positioning means are provided formed with the hull for positioning each bladder with respect to the hull. The positioning means may take the form of a plurality of generally horizontally extending through-extending openings formed in the hull generally above the waterline. Holding means are provided cooperating with the hull positioning means and each of said bladders for holding each bladder to the hull at said positioning means when the bladder is inflated, and allowing ready demounting of the bladder from the hull when the bladder is deflated. Such holding means may take the form of a neck portion integral with the bladder, and an enlarged portion or rigid flange operatively connected to the neck. When the neck and the enlarged portion, or rigid flange, are passed through the hull positioning opening, upon inflation of the bladder they are maintained in contact with the interior surface of the hull and prevent detachment of the bladder from the hull.

According to the present invention, it is also often desirable to provide interlocking cooperating end portions of the bladders, such as V-shaped projections and troughs, spherical portions and spherical cavities, etc., to stabilize the positions of the bladder vis-a-vis each other and the hull. Further, it is often desirable to provide a shroud(s) surrounding each, or a plurality, of the bladders. The shroud(s) preferably is held to the hull by the bladder holding means.

It is the primary object of the present invention to provide an advantageous structure facilitating the constructions, deployment, and storage of RIBs. This and other objects of the invention will be come clear from an inspection of the detailed description, and from the appended claims.

DETAILED DESCRIPTION OF THE DRAWINGS

Figure 1:
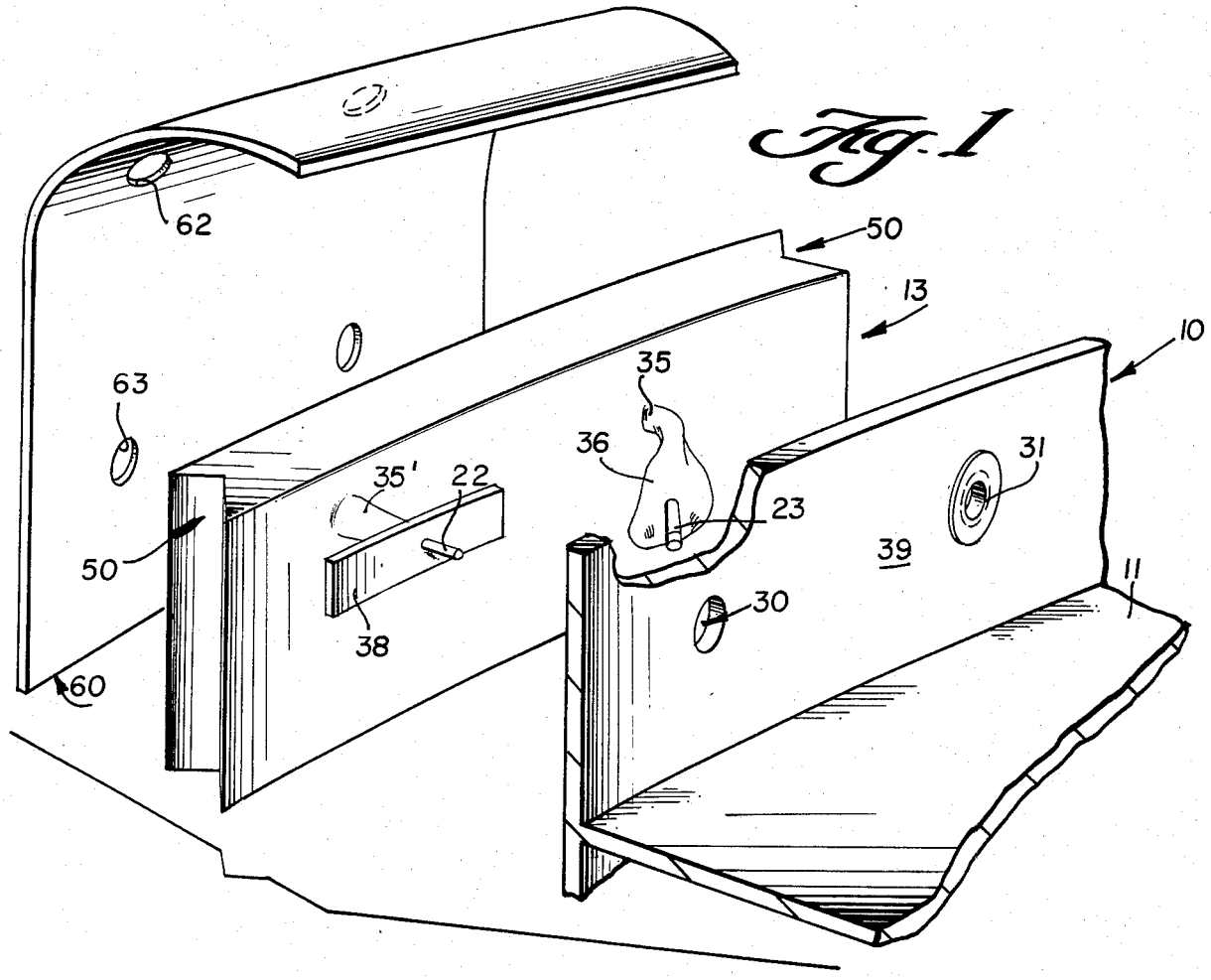
FIG. 1 is a perspective detailed exploded view showing various components of an exemplary structure according to the present invention in association with the rigid hull of a RIB.
Figure 2A:
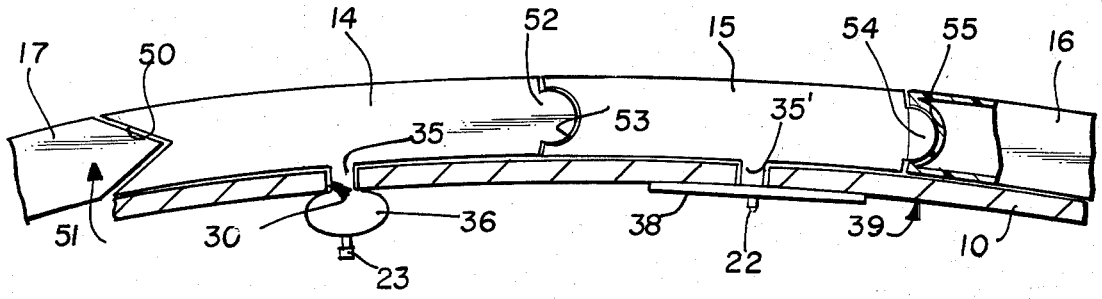
FIG. 2*a* is a top view, partly in cross-section and partly in elevation, of a section of a RIB constructed in accordance with the teachings of the present invention.
Figure 2B:
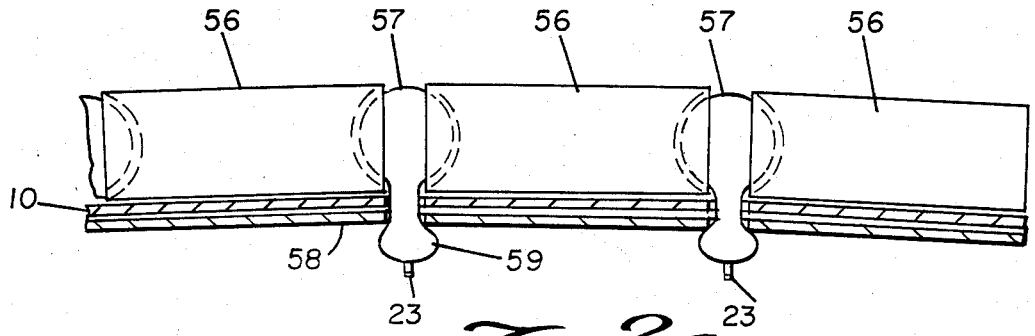
FIG. 2*b* is a similar view of another embodiment.

FIG. 1 shows a GRP or aluminum rigid hull 10 of an RIB, a sole 11 being illustrated in the drawing, but not essential. While the hull 10 is shown with a one-piece construction for simplicity of illustration, it may be formed with a two-piece construction (i.e., with a "liner") over at least a portion of the above-waterline part thereof, and the term "hull" as used in the present specification and claims is intended to encompass a wide variety of configurations of boat bodies.

According to the present invention, a plurality of inflatable bladders are provided in combination with the hull 10. Various configurations of the bladders are illustrated in the drawings by reference numerals 13–19. The bladders are disposed in end-to-end relationship substantially around the entire outer periphery of the hull 10 to define an inflatable ring generally at, or above, the waterline of the boat. The bladders 13–19 typically are made of elastomeric material, such as natural rubber, synthetic rubber, or elastomer-coated fabric. At least one valve is associated with each bladder 13–19 to provide for the inflation, or deflation, thereof, various valves being illustrated in the drawings by reference numerals 22–25.

According to the present invention, positioning means are formed with the hull 10 for positioning the bladders 13–19 with respect to the hull 10. In the embodiments illustrated in FIGS. 1–4, the positioning means takes the form of at least one generally horizontal through-extending opening 30 associated with each bladder 13–18. The openings 30 are typically formed above the waterline of the boat, although the bladders 13–18 will tend to seal the openings 30, and additionally a separate sealing grommet (e.g., of rubber) 31 (see FIG. 1) could be provided in one or more openings 30.

The hull 10 may be specially formed (as with a concave exterior contour above the waterline) to provide positioning means receiving the bladders 13–19 therein. The hull may be contoured to mate with an inflatable tube or ring of conventional construction (whether sectioned or unsectioned) or with the plurality of bladders forming the ring, as illustrated in FIG. *2a*.

According to the present invention, there are also provided means cooperating with said hull positioning means and each of said bladders for holding each bladder to said hull at said positioning means when the bladder is inflated, but allowing ready detachment of the bladder from the hull when the bladder is deflated. Such holding means may take a wide variety of forms, a number of which are illustrated in the drawings. For instance in FIG. 1, two such holding means are shown associated with a single bladder 13, one of the holding means comprising a neck 35 integral with, and in fluid communication with, the bladder 13, and an enlarged inflatable component 36 integral with, and in fluid communication with, the neck 35. A similar component is illustrated in FIG. *2a* in association with a bladder 14, inflated and held in position with respect to the hull 10. When the bladder 13 or 14 is deflated, the enlarged portion 36 and neck 35 are passed through an opening 30 in the hull 10. Then the bladder 13 or 14 is inflated by a pumping compressed air through the valve 23, causing the portion 36, as well as the bladder 13 or 14, to inflate, the portion 36 preventing the bladder 13 or 14 from detaching from the hull 10.

Another embodiment of holding means according to the present invention is also illustrated in FIGS. 1 and *2a*, in this embodiment a neck 35' being in fluid communication with the bladder 13 or 15, and being operatively connected to a rigid flange 38. The flange 38 is dimensioned so that when the bladder 13, 15 is deflated, the flange can be passed through an opening 30, but then when the bladder 13, 15 is inflated the flange 38 will engage in interior side surface 39 of the hull 10 and will prevent the bladder 13, 15 from being detached from the hull 10. The valve 22 allows the bladder 13, 15 to be inflated from a position interiorly of the hull 10.

Figure 3:
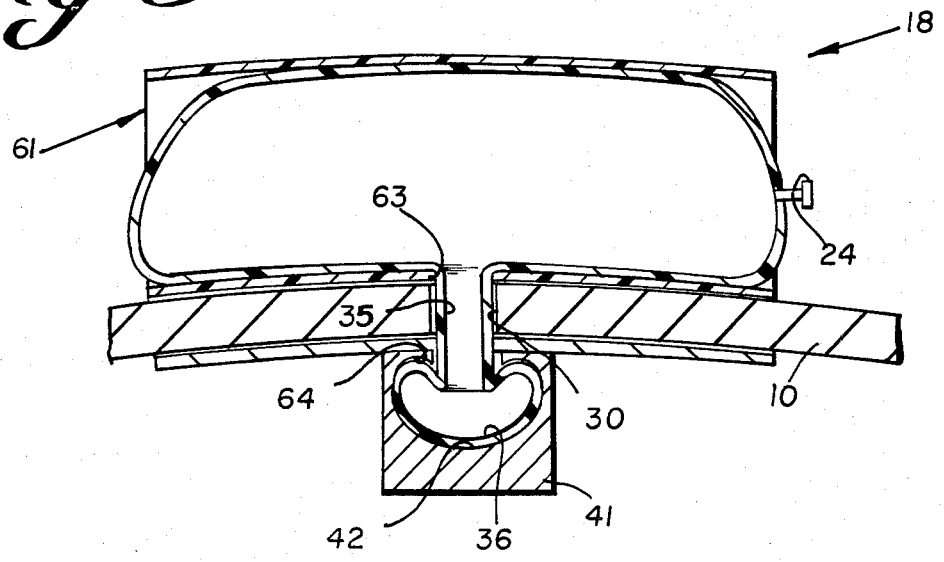
FIG. 3 is a top cross-sectional view of another exemplary embodiment according to the present invention.
Figure 4:
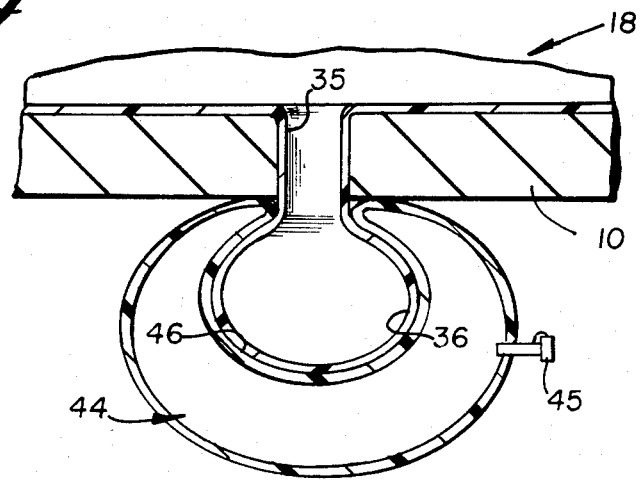
FIG. 4 is a top cross-sectional detailed view showing yet another exemplary embodiment of cooperating bladder holding components.

In the embodiments illustrated in FIGS. 3 and 4, in addition to the neck 35 and enlarged portion 36, the holding means include discrete additional structures for engaging the enlarged portion 36. For instance in FIG. 3, a rigid material in block 41 has means defining a female generally hemispherical cavity 42 therein, the member 36 pressing against the cavity 42 walls around substantially the entire periphery thereof and enhancing the holding action preventing the bladder 18 from being detached from the hull 10. In this embodiment, the valve 24 is provided on an end portion of the bladder 18.

The FIG. 4 embodiment is the same as the FIG. 3 embodiment as far as the bladder, neck, and enlarged portion are concerned, however in this embodiment the female cavity is formed by a discrete inflatable component 44 having a valve 45, and defining an interior female cavity 46. The cavity 46 receives the enlarged portion 36 of the holding means, and when the component 44 is inflated by causing compressed air to enter the valve 45, a tight gripping action is provided on the enlarged portion 36.

According to the present invention, it is also often desirable to provide means for stabilizing the positions of the bladders vis-a-vis each other and the hull 10. This may be accomplished by providing interlocking end structures on each of the bladders, such as illustrated for the bladders 13–17 in FIGS. 1 and 2. Such interlocking end structures can have a wide variety of configurations. For instance for the interlocking relationship between bladders 14 and 17 in FIG. 2, the bladder 14 has a female generally V-shaped trough 50, while the bladder 17 has generally V-shaped protrusion 51 contoured and dimensioned to engage the trough 50. At the other end of the bladder 14 from the trough 50, it has a generally cylindrical male portion 52, which is received by the generally cylindrical cavity 53 female portion at the end bladder 15. At the opposite end of the bladder 15 from the cavity 53 is formed a hemispherical male protrusion 54, which is received and held by a hemispherical female cavity 55 of the bladder 16. Normally, each bladder will have a male interlocking component at one end thereof, and a female interlocking component at the other end thereof, although alternating bladders may have two male interlocking ends, and two female interlocking ends. For instance, the bladder 13 in FIG. 1 has two V-shaped troughs 50 at the ends thereof, which troughs will cooperate with corresponding V-shaped protrusions 51 on adjacent bladders.

In the FIG. *2b* embodiment of the invention, the bladders 56 alternate with the bladders 57. The bladders 56 are substantially cylindrical having hemispherical cavities formed at the ends thereof, and the bladders 57 are substantially spherical and are connected by necks 58 to enlarged portions 59 having valves 23 therein. In FIG. *2b*, the hull 10 is shown with a two-part construction.

In order to protect the bladders from sunlight, cover any edges of the bladders that may be caught upon objects, and to provide rub resistance (i.e., protect) for the bladders, it is often desirable to provide one or more shrouds. A shroud may be associated with each bladder, or a plurality of bladders, or a single shroud may cover all of the bladders. One form the shroud may take is shown by reference numeral 60 in FIG. 1, another form is shown by reference numeral 61 in FIG. 3, and another form is shown by numeral 65 in FIG. 8.

The shroud 60, 61, 65 preferably is formed of a flexible sheet of resilient material, such as an elastomeric material sheet. The shrouds 60, 61, 65 are configured and dimensioned to surround the bladders 13, 18 with which each is associated. The shrouds 60, 61, 65 are preferably attached to the hull 10 by the same holding and positioning means as the bladders 13, 18. For instance, means are provided defining openings 62, 63 in shroud 60 for cooperating with the opening 30 and flange 38 of the bladder 13. In FIG. 3, the shroud 61 is shown wrapped around the bladder 18, the neck 35 passing through openings 63, 64 formed in opposite ends of the shroud 61.

The bladder 18 illustrated in FIG. 3 does not have end positioning means associated therewith. Rather the bladder 18 will merely abut adjacent bladders, and the bladders can be dimensioned so that when inflated a secure abutting action is provided therebetween.

Figure 8:
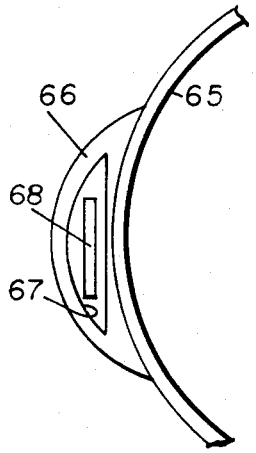
FIG. 8 is an end view of another form of shroud utilizable in practicing the present invention.

For the shroud 65 shown in FIG. 8, a rub strake 66 is formed integrally therewith along the length thereof, and the shroud 65 is connected to the hull 10 in such a manner that the rub strake 66 is exterior of the hull and the bladders, and parallel to the hull. Means are provided defining an elongated opening 67 within and along the length of the rub strake 66, the opening 67 for receipt of a strap 68. When the shroud 65 is put in place and a strap 68 passed entirely through the opening 67, the strap 68 may be tightened at its ends. This may facilitate positioning of the shroud 65, and bladders surrounding thereby, and also may provide a means for deflating the bladders when deflation is desirable. By opening all of the valves 22, 23, etc., and then pulling tightly on the strap 68, air will be forced out of the bladders with which shroud 65 is associated.

Figure 5:
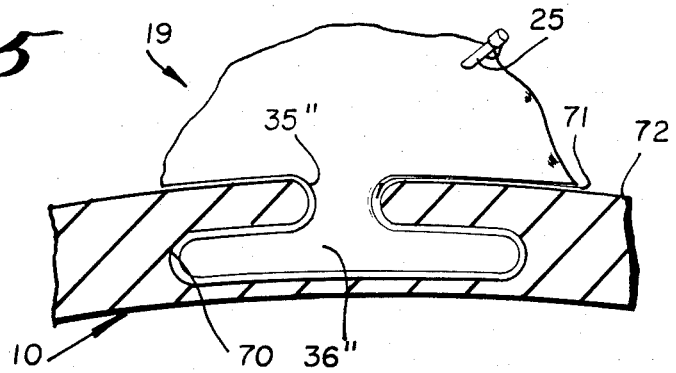
FIG. 5 is a top view, partly in cross-section and partly in elevation, of a portion of still another exemplary embodiment of positioning and bladder holding means.

In the FIG. 5 embodiment, the positioning means associated with the hull 10 are different than in the FIGS. 1–4 embodiment. In the FIG. 5 embodiment, the positioning means comprise means defining a contoured cavity 70 within the interior of the hull 10, and means defining an access opening 71 extending from the cavity 70 to the exterior side surface 72 of the hull 10. The cavity 70 may be defined by two spaced parts of hull 10. The holding means comprises a neck portion 35″, and an enlarged portion 36″ of the bladder 19. Enlarged portion 36″ is pushed into the cavity 70, and when the bladder 19 is inflated by passing compressed air through valve 25, the portion 36″ engages the entire surface of the cavity 70 and is tightly held in place.

Figure 6:
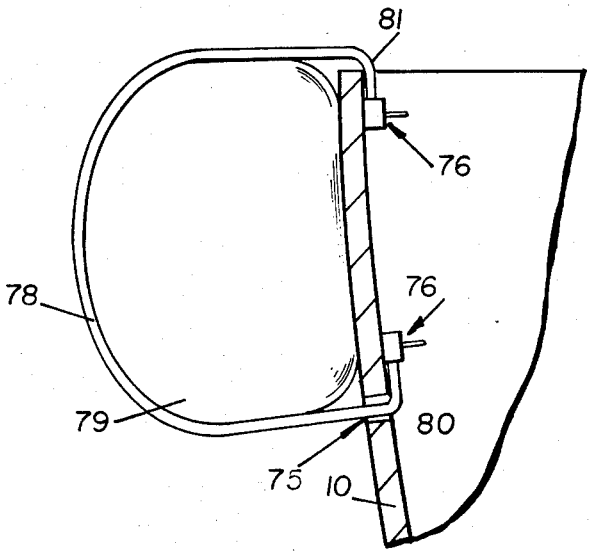
FIG. 6 is an end view of another exemplary embodiment of positioning and bladder holding means.

In the FIG. 6 embodiment, the positioning means formed with the hull 10 include, in addition to through-extending openings 75, clamping means 76. Also in this embodiment, the holding means comprise a strap 78 formed integrally with the bladder 79 along a large portion of the circumference thereof (e.g., about 180°), and having a pair of free ends 80, 81 which cooperate with the clamping means 76. The strap end 81 is passed over the top of the hull 10 (or through an opening formed adjacent the top of the hull 10), while the strap end 80 is passed through the opening 75, both strap ends being passed into operative association with clamping means 76.

Figure 7:
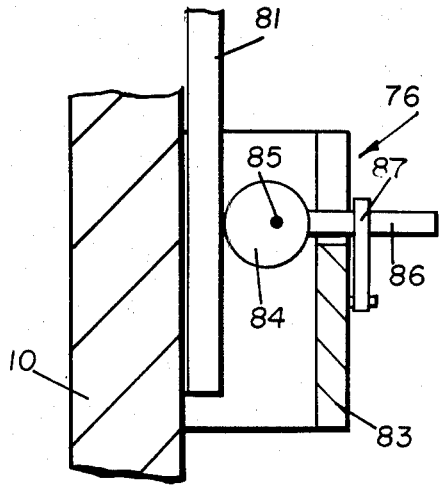
FIG. 7 is a detail side cross-sectional view of exemplary clamping means associated with the embodiment of FIG. 6.

The clamping means 76 may take a wide variety of forms. One particular form is illustrated in FIG. 7 wherein the clamping means 76 comprises a substantially channel-shaped body 83 integral with the hull 10 and having an eccentric cam 84 mounted for pivotal movement about pivot pin 85, the pivot pin 85 extending between the ends of the body 83, and disposed generally perpendicular to the path of movement of the strap end 81. A handle 86 is integral with the cam 84, and is used to rotate the cam 84 about its pivot pin 85. A spring loaded latch, shown schematically by reference numeral 87, may be provided for releasably latching the handle 86 in the position illustrated in FIG. 7, in which position the strap end 81 is clamped tightly between the interior surface of the hull 10 and the external periphery of the cam 84.

It will thus be seen that according to the present invention it is possible to construct an RIB in a manner greatly facilitating rapid mounting and demounting of the inflatable component, and allowing easy repair thereof. The bladders 13–19, 56, 57, 79 are easily and quickly moved into place in association with the hull 10, and each other, and inflated to provide a continuous ring around the majority of the external periphery of the hull 10. The shrouds 60, 61, 65, when utilized, will protect the bladders; however, should a bladder be violated, it may be quickly and easily replaced.

While the invention has been herein shown and described in what is presently conceived to be the most practical and preferred embodiment thereof, it will be apparent to those of ordinary skill in the art that many modifications may be made thereof within the scope of the invention, which scope is to be according the broadest interpretation of the appended claims so as to emcompass all equivalent structures and devices.

What is claimed is:

1. In combination with a rigid hull of a boat:

a plurality of inflatable bladders, adapted to define a ring around and generally at or above the water level portion of the rigid hull;

positioning means formed with the hull for positioning said bladders with respect to the rigid hull, and exteriorly of the hull, and comprising:

means defining a plurality of spaced generally horizontally through-extending openings in the hull, and clamping means disposed interiorly of the hull;

holding means cooperating with said hull positioning means and at least some of said bladders for holding said bladders to the hull at said positioning means when said bladders are inflated, and providing ready detachment of said bladders from the hull when said bladders are deflated, and comprising: a strap operatively engaging each bladder when inflated along a portion of the length of the strap, the strap having remote free ends; and wherein said clamping means comprise means for receiving the free ends of said strap to releasably clamp said free ends so that they are held stationary with respect to said hull, thereby holding the inflated bladders to the hull.

2. In a combination as recited in claim 1 further comprising at least one shroud surrounding said bladders.

3. In a combination as recited in claim 2 wherein said at least one shroud includes a rub strake formed along the length thereof, means defining an opening within said rub strake, and a strap dimensioned to fit within said opening defined through said rub strake.

4. In combination with a rigid hull portion of a boat:

a plurality of inflatable bladders, positioned to generally define a ring around and generally at, or above, the water level of the hull, and including valve means associated with each bladder;

a shroud of flexible material surrounding at least some of said bladders, said shroud having first and second end portions thereof, both end portions operatively connected to the rigid hull portions, so that said shroud completely circumferentially surrounds at least some of said bladders when they are inflated; and said shroud including a rub strake formed along the length thereof, means defining an opening within said rub strake, and a strap dimensioned to fit within said opening, and movable within the opening with respect to the shroud.

5. In a combination as recited in claim 4 wherein said shroud comprises a resilient material, and further comprising means defining a plurality of openings in said shroud for receipt of holding means for cooperating with said rigid hull portion for holding said bladders to said rigid hull portion when said bladders are inflated, and providing ready detachment of said bladders from said rigid hull portion when said bladders are deflated.

6. In a combination as recited in claim 4 wherein said ring extends around substantially the entire periphery of said rigid hull portion, and wherein a single shroud is provided for surrounding all of the bladders forming said ring.

7. In a combination as recited in claim 4 wherein said shroud provides ready access to said valve means, said shroud including means defining an opening therein through which said valve means passes.

8. In combination with a rigid hull portion of a boat:

a plurality of inflatable bladders, positioned to generally define a ring around and generally at, or above, the water level of the hull, and including valve means associated with each bladder; and a shroud of flexible material surrounding at least some of said bladders, said shroud having first and second end portions thereof, both end portions operatively connected to the rigid hull portion at approximately the same point, so that said shroud completely circumferentially surrounds at least some of said bladders when they are inflated and extends outwardly from said rigid hull portion.

9. In a combination as recited in claim 8 wherein said shroud includes a rub strake formed along at least a part of the length thereof.

10. In a combination as recited in claim 9 further comprising means defining an opening within said rub strake, and a strap dimensioned to fit within said opening and movable within the opening with respect to the shroud.

11. In a combination as recited in claim 8 wherein said shroud comprises a resilient material, and further comprising means defining a plurality of openings in said shroud for receipt of holding means for cooperating with said rigid hull portion for holding said bladders to said rigid hull portion when said bladders are inflated, and providing ready detachment of said bladders from said rigid hull portion when said bladders are deflated.

12. In a combination as recited in claim 8 wherein said ring extends around substantially the entire periphery of said rigid hull portion, and wherein a single shroud is provided for surrounding all of the bladders forming said ring.

13. In a combination as recited in claim 8 wherein said shroud provides ready access to said valve means, said shroud including means defining an opening therein through which said valve means passes.

14. In combination with a rigid hull of a boat:

a plurality of inflatable bladders, adapted to define a ring around and generally at or above the water level portion of the hull;

positioning means formed with the hull for positioning said bladders with respect to the hull, and exteriorly of the hull, and comprising means defining a plurality of generally horizontally through-extending openings in the hull;

holding means cooperating with said hull positioning means and at least some of said bladders for holding said bladders to the hull at said positioning means when said bladders are inflated, and providing ready detachment of said bladders from the hull when said bladders are deflated, and comprising means integral with each said bladder and dimensioned to pass through a said through-extending opening from the exterior of the hull to the interior thereof when said bladder is deflated, and for engaging an interior surface of the hull to resist movement thereof through said through-extending opening when said bladder is inflated; and wherein said holding means comprise: a neck portion integral and in fluid communication with said bladder, and an enlarged inflatable portion integral with said neck portion and in fluid communication with said bladder; and a separate inflatable component provided interiorly of the hull and including means defining a female cavity therein when inflated; said separable inflatable component engaging said enlarged inflatable component of said bladder, with said enlarged inflatable portion of said bladder being received within said inflatable component female cavity.

* * * * *